US005729867A

United States Patent [19]

Carmichael

[11] Patent Number: 5,729,867

[45] Date of Patent: Mar. 24, 1998

[54] FLEXIBLE AND DETACHABLE WEB HINGE FOR DISPLAY PANELS CAPABLE OF ORIENTING ONE PANEL RELATIVE TO ANOTHER THROUGH 360 DEGREES

[76] Inventor: Carl C. Carmichael, 1528 Tampico Dr., Plano, Tex. 75075

[21] Appl. No.: 740,986

[22] Filed: Nov. 5, 1996

[51] Int. Cl.[6] ..... E05D 1/00

[52] U.S. Cl. ..... 16/225; 160/235; 16/DIG. 13

[58] Field of Search ..... 16/225, DIG. 13; 4/609, 607, 614, 557; 160/40, 186, 199, 206, 229.1, 235

[56] References Cited

U.S. PATENT DOCUMENTS

| | | | |
|---|---|---|---|
| 2,829,081 | 4/1958 | Sweem | 16/225 |
| 4,296,524 | 10/1981 | Horholt et al. | 16/DIG. 13 |
| 4,563,381 | 1/1986 | Woodland | 16/225 |
| 4,670,938 | 6/1987 | Fowlston | 16/225 |
| 4,828,132 | 5/1989 | Francis, Jr. et al. | 16/225 |
| 4,949,997 | 8/1990 | Champagne | 281/45 |
| 5,448,799 | 9/1995 | Stein, Jr. | 16/225 |
| 5,487,690 | 1/1996 | Stoffle et al. | 16/225 |

OTHER PUBLICATIONS

The Fabricators (Catalog) pp. 53–56; 171–172; 264–265

*Primary Examiner*—Chuck Mah
*Attorney, Agent, or Firm*—A. M. Fernandez

[57] ABSTRACT

A flexible web-hinge is extruded from plastic having two U-shaped parts connected together at the center of their backs by a flexible web, each with a slightly arced back and each having flat leaves extending from relatively rigid corners that are nearly right angles. The leaves extend from the edges of their backs toward each other such that a small gap is left between the free ends of the leaves through which a flat panel is to be inserted, one panel in each flexible hinge part. The flexible web from one hinge back to the other hinge back has a dimension that is greater than the outside width of the hinge back such that the leaves of each part is adapted to receive and grip a separate display panel, and one panel may be positioned relative to the other panel at any angle from 0° to 360°.

3 Claims, 4 Drawing Sheets

FLEXIBLE AND DETACHABLE WEB HINGE FOR DISPLAY PANELS CAPABLE OF ORIENTING ONE PANEL RELATIVE TO ANOTHER THROUGH 360 DEGREES

FIELD OF THE INVENTION

The invention relates to a flexible web device for hinging display panels together, such as foe boards, with the ability to position one display panel relative to another at any angle from close together on one side to any position through 360° to and including close together on their other side.

BACKGROUND OF THE INVENTION

The problem of hinging detachable panels in order to position the face of one panel relative to that of another at any angle for use as free-standing display panels has sometimes been solved by using hinge devices having knuckles through which a pin passes to join its leaves that are in turn fastened to the panels. An example is disclosed in U.S. Pat. No. 4,949,997. While that solution allows positioning adjacent panels at virtually any angle with respect to each other, it is costly not only to manufacture but also to use since the leaves must be attached to the panels by some mechanical means such as screws, or else with cement, both of which may render the hinges and/or panels unsalvable when the display is knocked down.

An alternative to the knuckle hinge is a web hinge which may be readily extruded with two leaves on each side of a flexible web formed in the extrusion, as shown in U.S. Pat. No. 4,563,381, but there the positioning of one panel relative to another is restricted in one direction, i.e., one panel is incapable of being positioned on either side flat against another panel because the one panel cannot swing in one direction through an angle much more than about 40°.

It would be desirable to have the option of positioning one panel relative to an adjacent hinged panel at any angle as much as 180° in either direction from an inline position. The limitation of the web hinge constructed as shown in U.S. Pat. No. 4,563,381 can be readily appreciated from the illustrations of U.S. Pat. No. 4,670,938 which concerns a hinged lid for a container that may swing up another 180° from the closed container position shown beyond an inline (horizontal) position until the hinged panel is flat against the top or lid panel of the container. That is all that was required of the hinge in that particular application. For deployment of free standing display panels, it is desirable to be able to position each of several panels relative to adjacent panels at any position through 180° in either direction from an inline position.

STATEMENT OF THE INVENTION

In accordance with the present invention, extruded flexible hinges are produced from plastic, such as polypropylene, having two parts U-shaped in cross section, each with a slightly arced back and each having flat leaves extending from the edges of their backs toward each other such that a small gap is left between the free ends of the leaves through which a flat panel is to be inserted, one panel in each flexible hinge part. Thus, each part is adapted to receive and grip a separate display panel.

The slightly arced back of one U-shaped part is connected by a flexible web to the slightly arced back of another part, the flexible web having a dimension from the back of one part to the back of the other part that is greater than the width of the backs of the hinged parts measured from the outside on one side to the outside on the other side of the back and preferably having a dimension that is about 1.75 times that measured width of the back of one U-shaped part for free-standing display panels.

The back of each hinge part is selected to have an inside dimension approximately equal to the thickness of the display panels to be joined by the extruded web hinge. Each U-shaped part has leaves extending out from the back with a spacing between their free ends remote from the back significantly less than the spacing between the leaves at the back so that, as the leaves are forced to spread apart to receive a panel, the back must bend and thus provide a gripping force on the inserted panel. The ratio of the gap spacing of the leaves at their outer ends to the spacing between the leaves at their inner ends is preferably on the order of 3/20, and the ratio of the thickness of the web portion to the thickness of the leaves is preferably on the order of 1.3/3.5.

Ridges running along the inside of the leaves parallel to the web-hinged backs are provided to enhance the grip of the leaves on the panels.

The novel features that are considered characteristic of this invention are set forth with particularity in the appended claims. The invention will best be understood from the following description when read in connection with the accompanying drawings.

BRIEF DESCRIPTION OF THE DRAWINGS

FIG. 4*a* illustrates schematically three display panels hinged with three of the flexible hinges of the present invention shown in FIG. 1 to form a Δ-shaped free-standing display and FIG. 4*b* illustrates two Δ-shaped free-standing displays stacked for greater display area, while

DETAILED DESCRIPTION OF THE INVENTION

Figure 1:
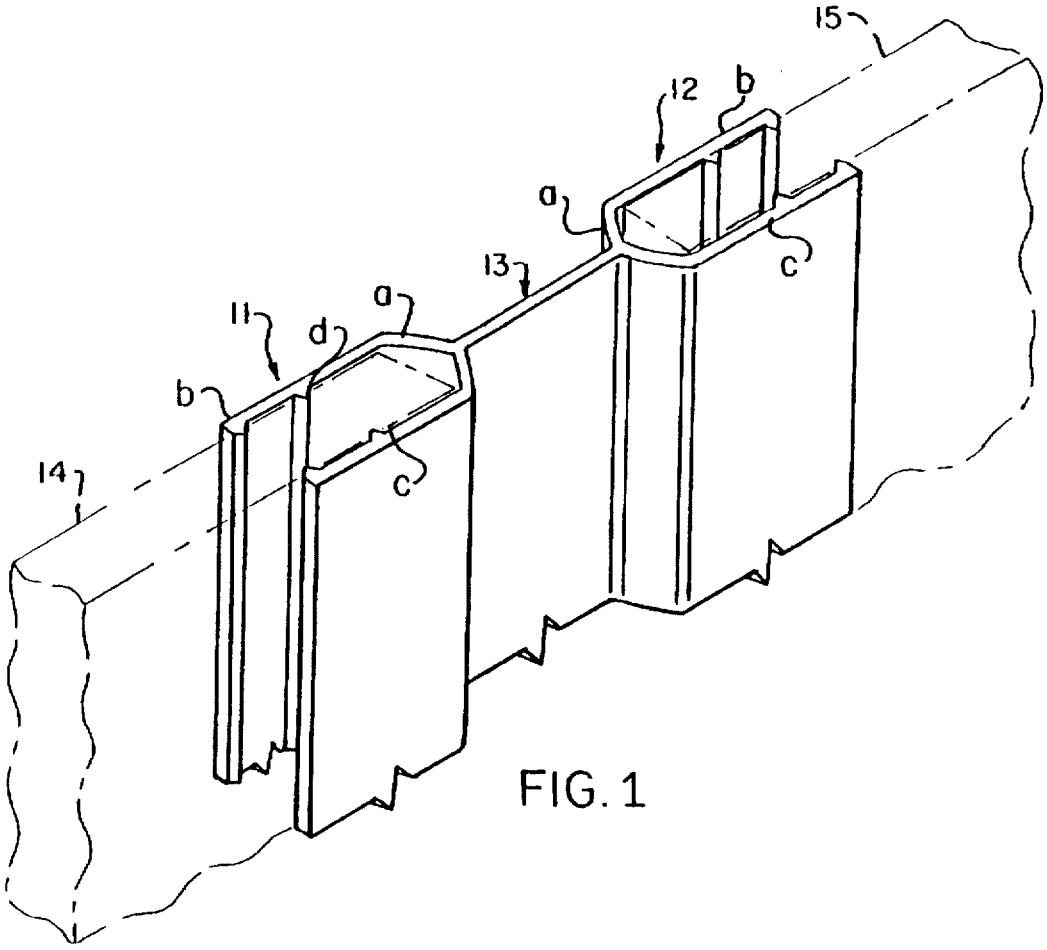
FIG. 1 is an isometric view of an extruded flexible hinge used to hold panels together (shown in phantom lines) in accordance with the present invention.

FIG. 1 illustrates in a perspective view a plastic extrusion of a flexible hinge having two U-shaped parts 11 and 12 and a flexible web 13 extending between and centered on the backs a of the two U-shaped parts 11 and 12. The dimension of the web 13 from one back a to the other is preferably greater than the width of the back part a, as shown in the top view of FIG. 2 without the panels 14 and 15 shown in FIG.

1. Note that leaves b and b are shown parallel to each other in FIG. 1 when panels 14 and 15 having a thickness substantially equal to the width of the back a are in place, but both extend at a slight angle toward each other in such a manner as to leave a small gap between their free ends when panels are not in place as shown in FIG. 2.

Figure 2:
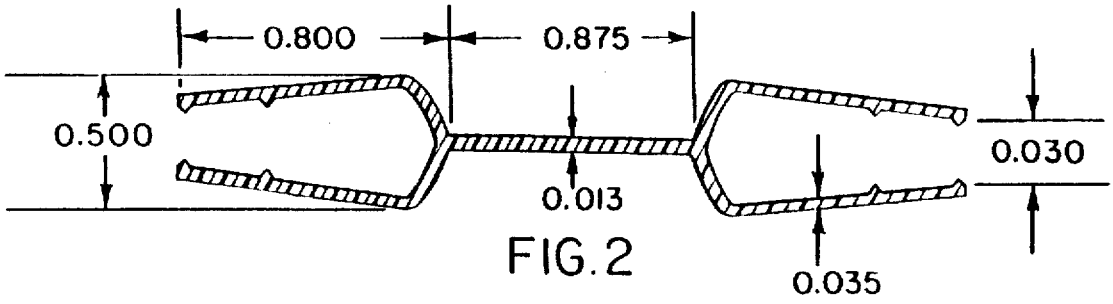
FIG. 2 is a cross section of the extruded flexible hinge of FIG. 1 without showing panels in place.

The width of the back a is shown in FIG. 2 to be a small fraction (about 0.500) of a unit, but as extruded the back a is preferably slightly arced so as to cause the spacing between the leaves b and c at the back a to be slightly less than the intended width of the back a. This causes the leaves b and c of the hinge to close at their free ends to a gap that is a smaller fraction (about 0.030) of a unit than the width of the back. When a panel having a thickness equal to about a fraction (about 0.500) of a unit is forced in between the leaves b and c, the arced shape of the back a tends to bend out to a flat-back shape, thus providing a gripping force of the leaves on the panel. Ridges on the inside faces of the leaves b and c that are parallel to the back a enhance this gripping force.

Figure 3:
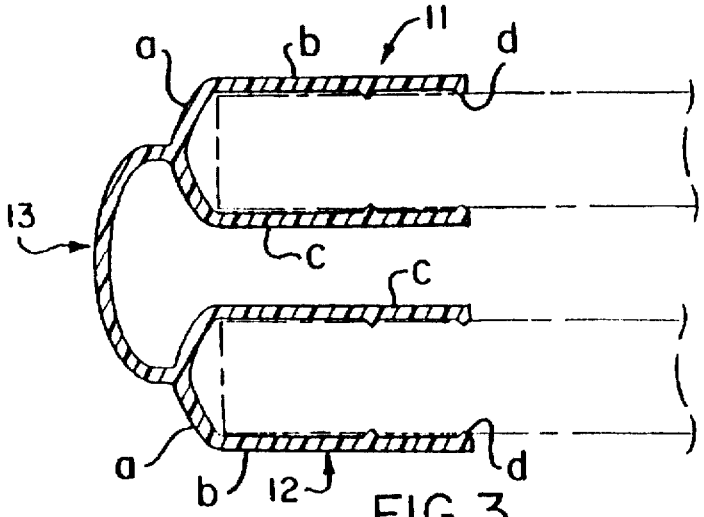
FIG. 3 is a cross section of the extruded flexible hinge of FIG. 1 with one hinge and panel shown moved through 180° to a position in respect to the other hinge, which is a feature of the present invention.

The length of the web 13 is required to be greater than the width of the back a of the flexible hinge shown in FIG. 2 to be a fraction (about 0.875) of a unit and the width of the back a to be a smaller fraction (about 0.500) of a unit, where a unit may be arbitrarily selected for the scale of the flexible hinge desired, which in turn will depend upon the size and thickness of the panels, typically less than about one inch or 2.5 cm. That web dimension is not of itself important. Instead, the ratio of the width of the back a of each U-shaped part to the length (extent) of the flexible web 13 between the parts is important. That ratio is preferably about 0.500/0.875=1/1.75. This will allow one of the panels 14 and 15 shown in phantom lines in FIG. 1 to be easily moved from the position of the two U-shaped parts 11 and 12 shown inline through 180° in either direction to a position of the two U-shaped parts 11 and 12 parallel and close to each other as illustrated in FIG. 3.

To facilitate the bending of the flexible web 13, the ratio of its thickness to the thickness of the leaves b and c of the U-shaped parts is selected to be about 1.3/3.5. All dimensions shown in FIG. 2 are in fractions of a unit which as noted above may be less than one inch or about 2.5 cm and usually much less, such as one half inch for art or other display applications, but may be scaled up for other applications. With this ratio, panels 14 and 15 may be placed at any convenient angle with respect to each other for free-standing display applications and fanfolded back to back one panel folded back onto the next in an array of any number of display panels for storage or carrying.

Figure 4A:
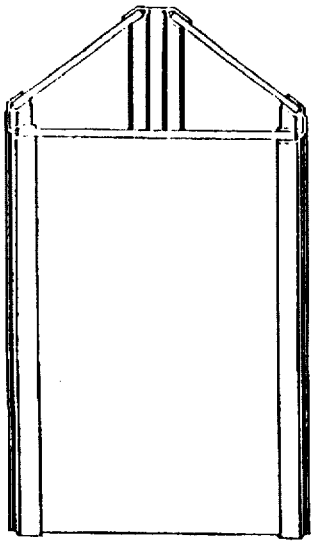
Figure 4B:
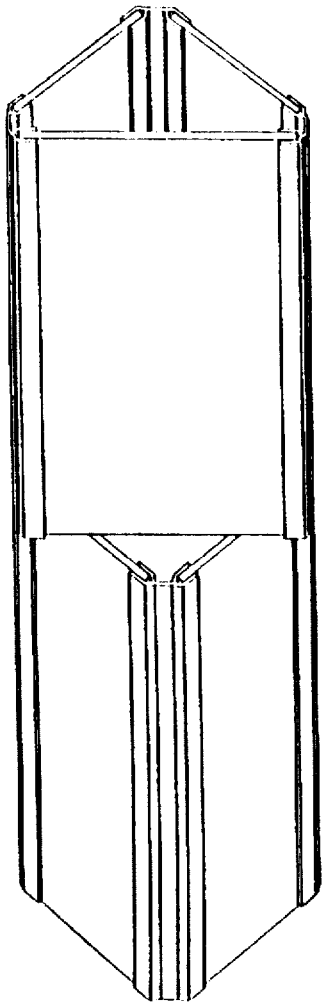
Figure 4C:
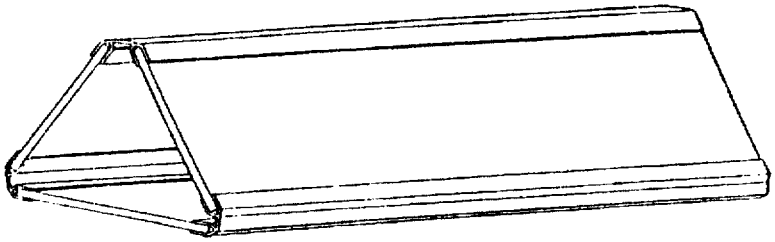
FIG. 4*c* illustrates a Δ-shaped free-standing display unit oriented horizontally for viewing displays on two very stable panels.
Figure 5A:
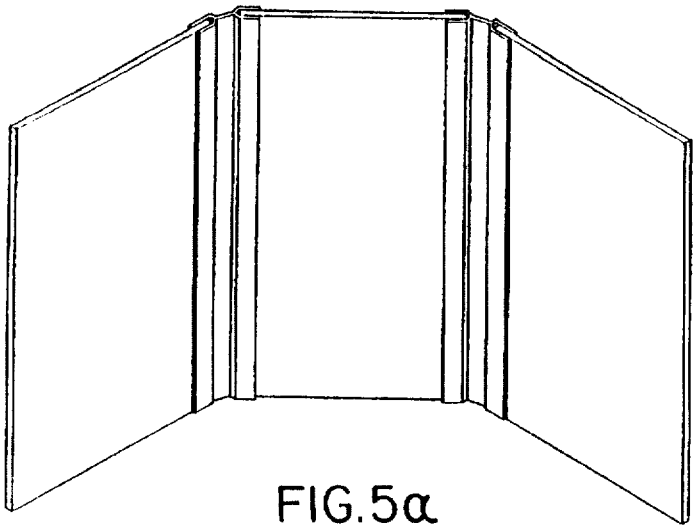
FIG. 5*a* illustrates the three panels of FIG. 4*a* hinged with only two flexible hinges of the present invention to provide three stable display panels with display area on both sides.
Figure 5B:
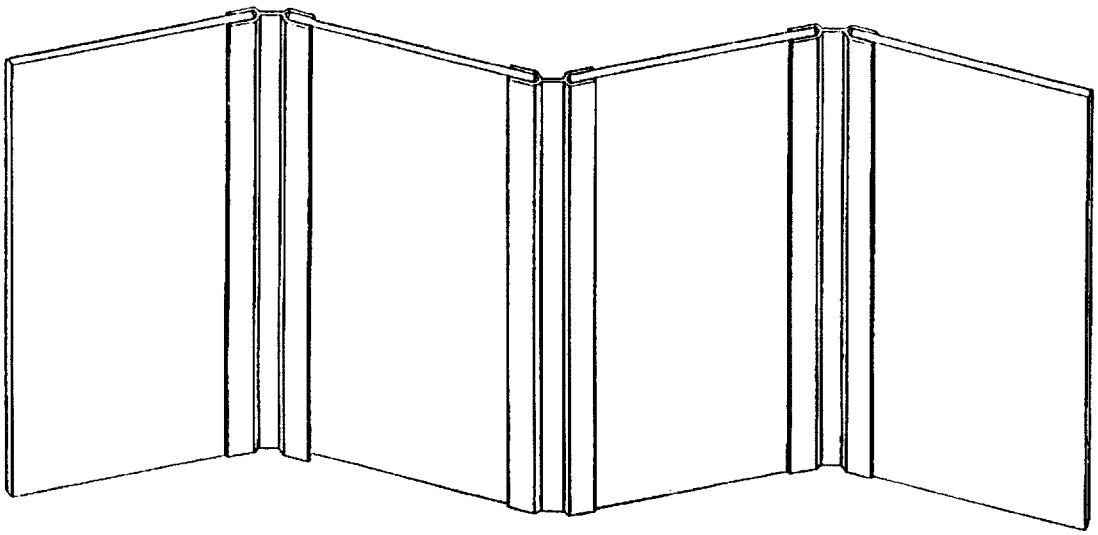
FIG. 5*b* illustrates how the number of display panels may be increased virtually without limit by adding hinges and panels.
Figure 6:
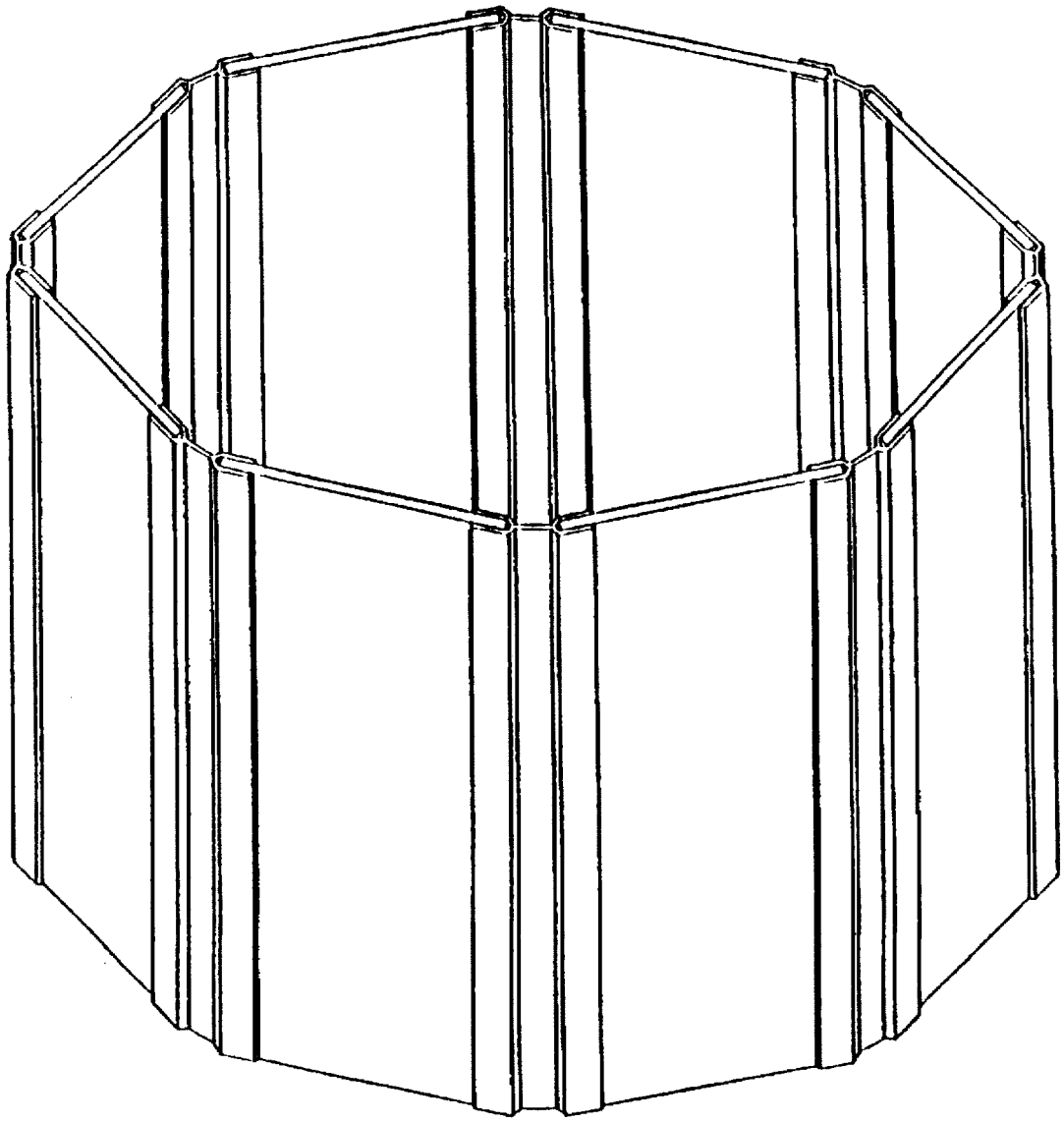
FIG. 6 illustrates an extension of the arrangement shown in FIGS. 5*a* and 5*b* to show that the number of hinged display panels may be extended virtually without limit, and closing the arrangements by joining the two end panels of an extended array of panels as shown.

Three panels hinged together with three flexible hinges may be positioned in Δ-shape to form a sturdy free-standing, three-sided display as schematically illustrated in FIG. 4*a*, and two such Δ-shape display arrangements may be stacked as schematically illustrated in FIG. 4*b*. The Δ-shape arrangement of three panels may also be placed with one side panel down on a table top for a two-sided display as schematically illustrated in FIG. 4*c*. Alternatively, three-panel arrangements using only two flexible hinges may be formed as schematically illustrated in FIG. 5*a*, and a four-panel arrangement using three flexible hinges may be formed in a zigzag arrangement as shown in FIG. 5*b*. Many more panels, using N panels with N-1 hinges, may be used to expand the arrangements of FIG. 5*b*, and in an arcuate arrangement.

A major feature of this invention is that the extruded flexible hinges may allow panels to be folded one upon the other in a fanfold manner for carrying or storage. The length of each extrusion is arbitrary, but a length of about four feet or one meter would be convenient since the plastic extrusion may be easily cut for shorter lengths of two or more panels to be joined by one or more extruded flexible hinges between each pair of panels in a group, such as two panels arranged to be free standing in a V arrangement, or three panels in a closed Δ or open N arrangement, respectively, or four panels in an open M arrangement. In fact, any number greater than four can be positioned in most any geometric arrangement of panels including closed rectangular, circular or elliptical forms as well as in any zigzag form and in stacks of some closed geometric forms, such as a stack of two arrangements in a closed triangle Δ form. In the case of a free-standing display of a number of panels with the same number of flexible hinges to form a closed geometric shape such as an arcuate or elliptical shape, uncoupling the panels at one hinge will, of course, permit all N panels to be fanfolded for storage or carrying.

Although particular embodiments of the invention have been described and illustrated herein, it is recognized that modifications may readily occur to those skilled in the art. Consequently, it is intended that the claims be interpreted to cover such modifications and equivalents thereof.

What is claimed is:

1. An extruded monolithic flexible plastic hinge comprising two U-shaped parts, each U-shaped part being a mirror image of the other part, and each having a back of the same width for supporting two spaced apart flat leaves attached to opposite edges of said back and a flexible web extending between center lines of said backs of said two U-shaped parts, said leaves extending from opposite edges of said back toward each other at their free ends remote from said back such that a gap is provided between said free ends of said leaves through which said flat panel is inserted that is smaller than between said leaves at said back from which they extend, and said flexible web having a dimension measured from said back of one U-shaped part to the back of the other U-shaped part that is greater than a width dimension of said back of each of said U-shaped part measured from an outer surface of one edge of said back to an outer surface of the other edge of said back, whereby either one of said two U-shaped parts may be positioned at any angle with respect to the other through 360° from a position flat against one side of said other U-shaped part to a position flat against the other side of said other U-shaped part while bending said flexible web.

2. An extruded flexible hinge as defined in claim 1 wherein the ratio of said dimension of said flexible web to said width dimension of said back of each of said two U-shaped parts is 1.75 to 1 units.

3. An extruded flexible hinge as defined in claim 2 wherein the thickness of said back and said leaves is about 0.035 of a unit and the ratio of thickness of said flexible web to thickness of said back and leaves is about 1 to 2.7 units.

* * * * *